United States Patent [19]

Epis

[11] 4,199,763

[45] Apr. 22, 1980

[54] ELECTRICAL-LENGTH EQUALIZER FOR HORN ANTENNAS

[75] Inventor: James J. Epis, Sunnyvale, Calif.

[73] Assignee: The United States of America as represented by the Secretary of the Navy, Washington, D.C.

[21] Appl. No.: 228,179

[22] Filed: Feb. 22, 1972

[51] Int. Cl.[2] ..... H01Q 13/00

[52] U.S. Cl. ..... 343/778; 333/157

[58] Field of Search ..... 333/34, 157; 343/778

[56] References Cited

U.S. PATENT DOCUMENTS 2,850,705 9/1958 Chait et al. ..... 333/34

*Primary Examiner*—Maynard R. Wilbur

*Assistant Examiner*—Richard E. Berger

*Attorney, Agent, or Firm*—R. S. Sciascia; Charles D. B. Curry

[57] ABSTRACT

A doubly-ridged waveguide device acts an an electrical-length equalizer or phase compensator for a pair of horn antennas of different physical length and/or aperture size. The phase compensator comprises a central doubly-ridged waveguide section with a uniform cross-sectional area and two similar doubly-ridged tapered waveguide transmission lines with cross-sections and ridge depth that continuously vary, located at either end of the central section. The width of the ridge is constant along the entire length of the structure. The device is connected in the standard waveguide transmission line of the smaller of the two horns.

7 Claims, 8 Drawing Figures

AIR GAP
X AXIS
Y AXIS
Z = L_T
L_T
R_C
b(z)
a(z)
S_R
S
d
R
b
a
b_o
a_o
R_1
R_2
R_3
R_4

ELECTRICAL-LENGTH EQUALIZER FOR HORN ANTENNAS

BACKGROUND OF THE INVENTION

1. Field of the Invention

This invention relates generally to a phase compensator for multiple horn antenna systems and more particularly to a doubly-ridged waveguide device which acts as an electrical-length equalizer for horn antennas with different physical lengths or aperature sizes.

2. Description of the Prior Art

In certain transmitting and/or receiving systems containing a multiplicity or an array of horn antennas, the far-zone radiated fields of any number of those horns, in certain preferred spatial directions, must often be in time phase over a broad frequency band. If all horns in the array are physically identical, the attendant design problem is trivial because in that case the designer would only have to ensure that all transmission lines connected to the horns and that all components therein are essentially identical in length and cross- section. But, where two or more of the horns are substantially different in length and/or aperture size and when operation over broad frequency band widths is required, obtaining the corresponding phase equality of the far-zone radiated fields is not nearly so simple or obvious, nor has an adequate solution to the aforementioned problem been proposed until the development of the unique present invention.

The unique device of the present invention effectively solves the phase compensation problem for a pair of horn antennas of different physical lengths and/or aperture sizes by precisely equalizing the effective length of the horn antenna systems. Structural variations of the waveguide system connected to the smaller horn is employed. Moreover, the unique waveguide system will permit the antenna system to transmit relatively high peak and average power levels, comparable to those which a standard waveguide can safely handle.

SUMMARY OF THE INVENTION

Briefly, the present invention comprises a doubly-ridged waveguide device that acts as an electrical-length equalizer or phase compensator for a pair of horn antennas of different physical length and/or aperture size. The phase compensator comprises a central doubly-ridged waveguide section with a uniform cross-sectional area and two similar doubly-ridged tapered waveguide transmission lines with cross-sections and ridge depth that continuously vary, located at either end of the central section. The width of the ridge is constant along the entire length of the structure. The device is connected in the standard waveguide transmission line of the smaller of the two horns.

STATEMENT OF THE OBJECTS OF INVENTION

A primary object of the present invention is to provide a practical device which enables two or more horn antennas of different physical length and/or aperture sizes to become virtually identical in terms of their effective electrical length over a broad frequency band.

Another object of the present invention is to provide a device which will achieve a relatively small difference between the effective electrical lengths or phase delays of the two or more horns where this small phase difference varies with the signal frequency in a predetermined optimum fashion as may be prescribed or be necessary for certain special applications of the two horns.

Another object of the present invention is to provide a phase compensator which will permit the device to be used in antenna systems employed to transmit relatively high peak and average power levels, comparable to those which the standard rectangular waveguide can safely handle.

Other objects, advantages and novel features of the invention will become apparent from the following detailed description of the invention when considered in conjunction with the accompanying drawings.

BRIEF DESCRIPTION OF THE DRAWINGS

FIG. **5*a* is a transverse view of a square or rectangular horn antenna which may be used with the electrical length equalizer.

DESCRIPTION OF THE PREFERRED EMBODIMENTS

Figures 1, 2, 3, 4:
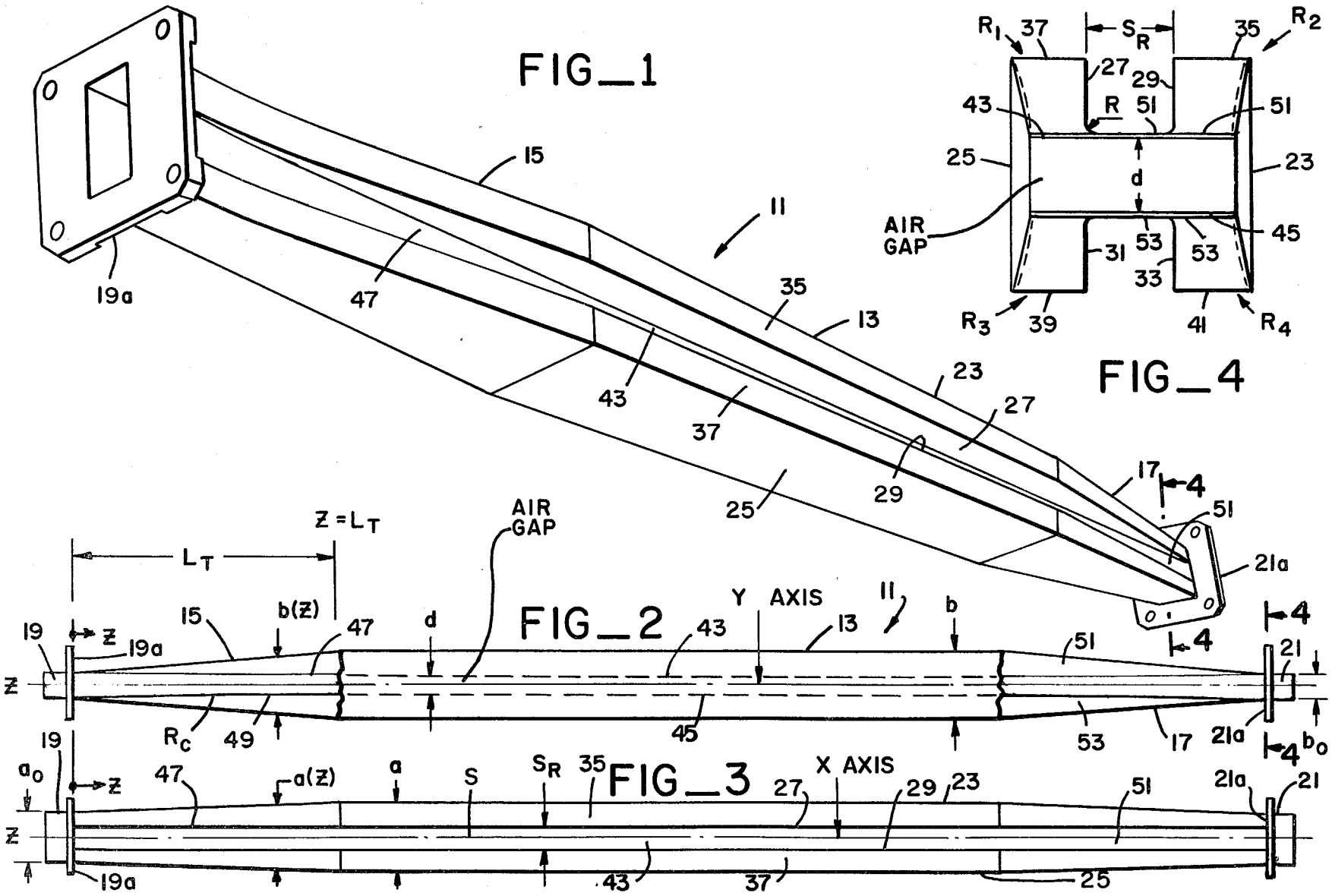
FIG. 1 is a pictorial representation of the electrical length equalizer for horn antennas.
FIG. 2 is a partially exposed side sectional view of the electrical length equalizer illustrated in FIG. 1 showing the internal hollow air gap "d" extending the entire length of the electrical length equalizer.
FIG. 3 is a top view showing the separation $S_R$ between the ridges of the electrical length equalizer illustrated in FIG. 1.
FIG. 4 is a transverse sectional view showing the hollow air gap "d" of the length equalizer of FIG. 1, taken along line 4—4 of FIGS. 1 and 2.

The electrical length equalizer device 11 of the present invention is generally shown in FIG. 1 and shown in more detail in FIGS. 2, 3 and 4. The electrical length equalizer generally comprises an internally hollow uniform doubly-ridged central section 13 and two hollow doubly-ridged nonuniform tapered waveguide sections 15 and 17. As illustrated in FIGS. 2 and 3, attached to each end of the tapered waveguide sections 15 and 17 are standard waveguides 19 and 21, respectively. It should be noted that standard waveguide couplings **19*a* and 21*a*, as best depicted in FIG. 1, may be attached to the standard waveguides 19 and 21**, or any other well known coupling techniques may be used.

The central section 13 includes two vertical exterior walls 23 and 25 with opposing vertical interior walls 27 and 29. Vertical exterior wall 23 is separated from vertical interior wall 27 by ridge wall 35 while vertical exterior wall 25 is separated from vertical interior wall 29 by ridge wall 37.

Ridged walls 39 and 41 separate vertical exterior walls 23 and 25 from vertical interior walls 31 and 33, respectively. The above mentioned wall structure is divided by channel sections 43 and 45 by an interior width distance $S_R$ to form vertical ridges $R_1$, $R_2$, $R_3$ and $R_4$. A cross sectional view of central section 13 is H-shaped in appearance with a hollow interior cavity extending into the interior portion of ridges $R_1$, $R_2$, $R_3$ and $R_4$ and along the entire length of central section 13. The separation between channel sections 43 and 45 form hollow air gap "d" which extends along the entire length of the central section 13. Moreover, the air gap "d" is uniform in cross section area along the entire length of central section 13. Referring again to FIGS. 2, 3 and 4, the interior width distance $S_R$ of the parallel ridges $R_1$, $R_2$, $R_3$ and $R_4$ are constant along the entire length of central section 13 as well as the nonuniform doubly-ridged waveguide sections 15 and 17. The ridges $R_1$, $R_2$, $R_3$ and $R_4$ in central section 13 are constructed in such a manner as to merge with the corresponding ridges $R_1$, $R_2$, $R_3$ and $R_4$ in tapered waveguide sections 15 and 17. Each of the ridges $R_1$, $R_2$, $R_3$ and $R_4$ in the tapered waveguide sections 15 and 17 follows a precise contour which will be analytically described later in subject application. However, the ridges $R_1$, $R_2$, $R_3$ and $R_4$ in the central section 13 are uniform both in cross section and length.

Referring now to FIGS. 1, 2, 2A, 3, and 4, a discussion of the construction of the two doubly-ridged nonuniform tapered waveguide sections 15 and 17 will follow. Since waveguide sections 15 and 17 are identical in shape and structure, a discussion of section 15 is deemed to apply to section 17. Moreover, it should be noted that a more complete mathematical description will follow later in the specification.

Referring to FIG. 2, the rate of taper b(Z) in the Y axis direction is a uniform rate along the Z axis direction so that the exterior walls of section 15 in the Y axis direction converges to conform to the internal height of a standard rectangular waveguide $b_o$.

Referring to FIG. 3, the rate of taper a(Z) in the Y axis direction is uniform along the Z axis direction so that the exterior walls of section 15 in the Y axis direction converge to correspond to the internal width of a standard rectangular waveguide $a_o$. It should be noted that the width of each of the ridges in both sections 15 and 17 vary at a rate a(Z) at any point Z. The nonuniform ridges in section 15 and 17 have a hollow interior which conforms to the exterior tapered contours. The contour sections 47 and 49 of tapered section 15 and contour 51 and 53 of section 17 form the nonuniform air gap "d" in the interior portion of tapered section 15 and 17, respectively.

Figure 2A:
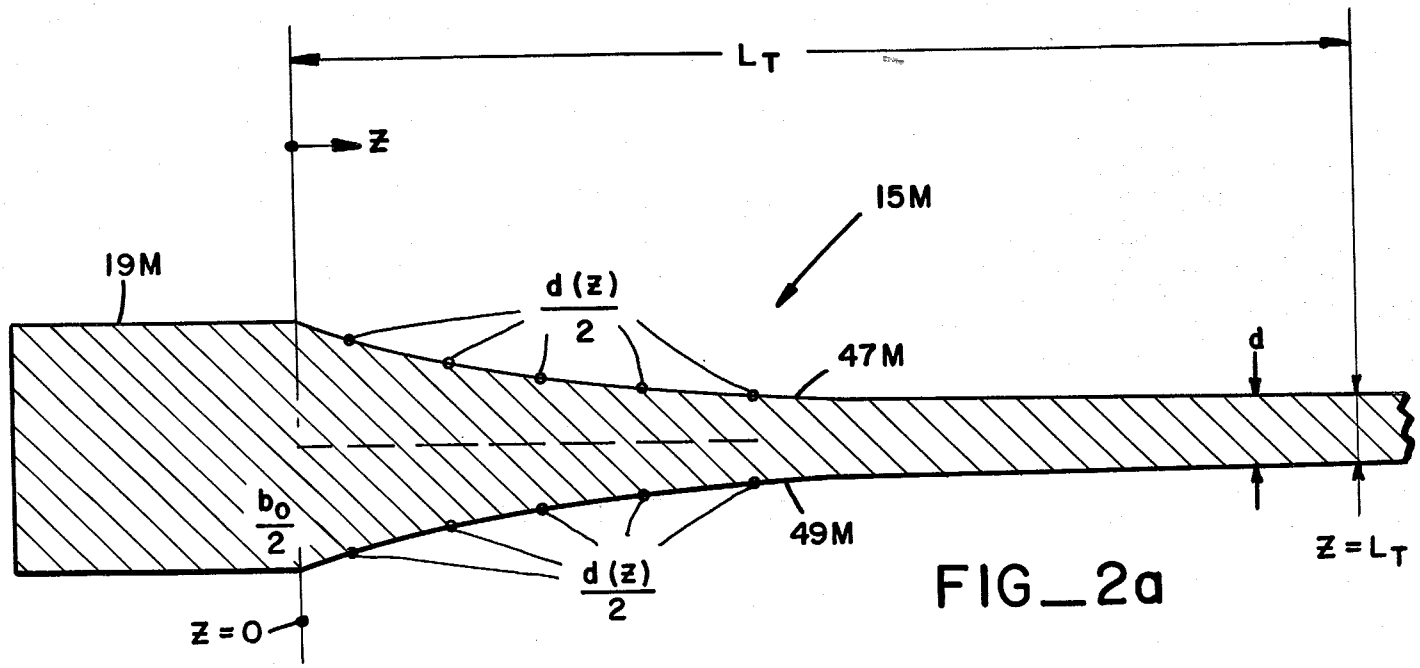
FIG. 2A is a cut-away side sectional view of a dual contoured mandrel, the contours of which are exaggerated for illustrative purposes, used to construct internal gap "d" of the two continuously varying contoured sections of the electrical length equalizer illustrated in FIGS. 1 and 2.

Referring to FIG. 2A, the illustrated figure shows both the specific contour curve as well as a general method for constructing the precise rate of contour for contour sections 47 and 49 of section 15 and 51 and 53 of section 17. It should be noted that the rate of contour has been exaggerated for purposes of illustration, the actual rate of contour being much less. (See Table I, (b) Ridge-Contour Curve Coordinates.) The mandrel illustrated could be used in conjunction with conventional electroplating methods to form contour sections 47, 49, 51 and 53. That is, the metal may be plated onto the contour of the mandrel to such a depth to form a rigid section on either side of the contour of the mandrel. Contour sections 47M and 49M of the mandrel 15M are used to form the interior walls of contour sections 47 and 49. The standard waveguide portion 19M may be used as an alignment guide to attach the standard waveguide 19 to the end portions of contour sections 47 and 49. Section 17 can be formed in a similar manner. The central section 13 and the ridges may be constructed and subsequently affixed to the contour sections by any of a number of well known methods. It should be also noted that equivalent standard machining process or methods could be used to construct the unique electrical length equalizer. These above methods provide the proper internal contours to construct the proper air gap "d" in sections 15 and 17.

In the preferred embodiment, constant gap width "d" must be large enough to reduce the maximum electric field to a value comparable in intensity to that prevailing in the standard rectangular waveguide, thereby permitting the electrical length equalizer to transmit at relatively high peak power levels. However, a relatively low cut-off frequency will often be required for the central-ridged waveguide section which can be achieved only by using relatively deep ridges therein. The aforementioned low cut-off frequency and all cross section dimensions of the electrical length equalizer may be obtained by calculations, as described later herein, such that the aforementioned requirements are met.

Rounded corners R are used on the ridges, as illustrated in FIG. 4. Such rounded corners R prevent the excitation of strong electric fields and strong electric currents localized in the immediate vicinity of the corners. Thus, the rounded corners R greatly reduce the likelihood of arcing or power breakdown and also reduce the power dissipation localized at the internal ridge corners. Values of R equal to approximately 0.275d, where d is the constant gap-width between the ridges in the central section 13, have proven to be very satisfactory in practice.

In achieving the relatively low cut-off frequency ($fc_R$) that is often required for the central section 13, as well as a sufficiently large gap "d" to achieve adequate peak power handling capability, requires that the resultant cross section of central section 13 to approach that of doubly-ridged square waveguide of appreciably larger size than that of the standard rectangular waveguide. The basic design criteria defined by $b_R/a_R=1$ where $b_R$ is the internal height of the central section 13 and $a_R$ is the width. $a_R=1.35\ a_o$ where $a_o$ is the internal width of the standard ridge rectangular waveguide. The aforementioned design dimensions have been found to be highly satisfactory in practice.

The value for $S_R/a_R$, where $S_R$ is the interior width, which permits the largest compatible gap dimension "d" to be used, corresponds to the design criteria of $S_R/a_R$ being approximately equal to 0.375. This is a particularly important criteria for cases wherein the apertures of the two horns being compensated are greatly different in size.

Referring to FIGS. 1, 2, and 3, it also has been found that proper operation of the electrical length equalizer 11 requires that all cross sections therein possess even symmetry in both orthogonal directions X and Y and that the entire device be constructed entirely straight and parallel to the Z direction; that is, the component must not contain any abrupt bends or even gradual curves of large radii.

The cross section of central section 13, as employed for a given case, is set by the design specifications described above plus one further factor. The other required factor is the cut-off frequency $f_{CR}$ of the lowest order of $TE_{10}$-Mode of propogation or the number of half period variations in said central section along the X axis, hereinafter referred to as $TE_{10}$-Mode. An equation for this required cut-off frequency $f_{CR}$ will be presented later herein where the description of the design details pertinent to the central section will be fully discussed.

Achieving the required horn-electrical-length-compensation is made possible by precisely designing the subject phase compensator in such a manner that the variation of the lowest order $TE_{10}$-Mode cut-off wavelength, $\lambda_c$, as a function of location Z, in either tapered section 15 and 17 satisfies a specific relationship, as illustrated in FIG. 2*a*. In particular, the cross section of each tapered section is varied continuously such that the equation $$\lambda_c(Z) = 2a_o + \left(\frac{\lambda\, CR - 2a_o}{L_T}\right)(Z) \tag{1}$$

is satisfied.

In the above equation:

$a_o$=internal width of the standard rectangular waveguide connected to either end of the equalizer (and to the two horns)

$\lambda_{CR}$=cut-off wavelength of the lowest order $TE_{10}$-Mode of propogation in the doubly-ridged central section (of uniform cross section)

$L_T$=Axial length of either tapered section

Judicious selection of equation (1), as a basic design specification, has permitted a rigorous mathematical derivation of an equation highly suitable for designing the complete equalizer or phase compensator. In particular, the following "design equation" applies:

$$[U_L(f) - U_S(f) + U_o(f)] + (n)(360) = 30.5\, L_R \sqrt{f^2 + f_{CR}^2} + \left\{\frac{61\, L_T f_{CR} f_{CO}}{f_{CO} - f_{CR}}\right\}\left\{\sqrt{\frac{(f)^2}{f_{CR}} - 1} - \sqrt{\frac{(f)^2}{f_{CO}} - 1} + \cos^{-1}\frac{(f_{CO})}{f} - \cos^{-1}\frac{(f_{CR})}{f}\right\} \tag{2}$$

Where:

$L_T$=Length of each tapered section (inches)

$L_R$=Length of central section (inches)

$f_{CO}$=$TE_{10}$-Mode cut-off frequency of the standard rectangular waveguide connected to each tapered section in Ghz $f_{CR}$=$TE_{10}$-Mode cut-off frequency of the central doubly-ridged waveguide section in Ghz $U_L(f)$=Total electrical length throat-to-Aperture of the large horn (in degrees)

$U_S(f)$=Total electrical length throat-to-Aperture of the small horn (in degrees)

$U_o(f)$=Optimum or desired electrical-length-excess, if any, of the large horn relative to the small-horn-plus-phase compensator (in degrees)

n=0,±1, -- −2, ------ ±m

In several constructed models of the invention the best overall performance was obtained when:

(a) $L_T$=2.37 λ 1 where λ 1 is the wavelength in inches at the lowest frequency in the required frequency band (b) $L_R=(L_L-L_S)-2L_T$ where $L_L$ and $L_S$ are the throat-to-Aperture physical length of the large and small horns, respectively.

(c) $$f_{CR} = \frac{L_L f_{CL} - L_S f_{CS} - L_T f_{CO}}{L_R + L_T} \tag{3}$$

$f_{CL}$ and $f_{CS}$ are the cut-off frequencies of the lowest order mode-of-propogation in a waveguide of cross section identical to those existing half-way along the axes of the large horns L and small horns S, respectively.

The value of $f_{CR}$, given by the equation above, specifies the cut-off frequency mentioned earlier of the doubly-ridged central section of the uniform cross section.

The function $U_L(f)-U_S(f)$, the actual electrical-length-difference between the large and small horns of physical length $L_L$ and $L_S$, respectively, can be obtained by experimental measurements made at a sufficient number of frequencies in the required frequency band. Alternatively, the function $U_L(f)-U_S(f)$ can also be obtained very accurately by computations using the following equation:

$$U_S(f) = \left(\left(\frac{360}{\lambda}\right)\right)\left(\left(\left\{\left[\sqrt{L_{2L}^2 - \frac{\lambda L_{2L}}{C_L D_L}^2} - \sqrt{L_{1L}^2 - \left(\frac{\lambda L_{2L}}{C_L D_L}\right)^2}\right] + \left[\frac{\lambda L_{2L}}{C_L D_L}\right]\left[\cos^{-1}\left(\frac{\lambda L_{2L}}{C_L D_L L_{1L}}\right) - \cos^{-1}\left(\frac{\lambda}{C_L D_L}\right)\right]\right\}\left\{\begin{matrix}\text{Same terms}\\ \text{with subscript}\\ L \text{ changed to } S\end{matrix}\right\}\right)\right)$$

Where:

L is the length of the large horn (subscript)

S is the length of the small horn (subscript)

Figure 5A:
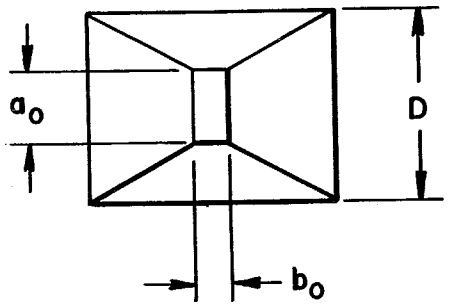
FIG. 5 is a side section view of a standard horn antenna which may be attached to the electrical length equalizer illustrated in FIG. 1.
FIG. 5*b*** is a transverse view of a conical horn antenna which may be used with the electrical length equalizer.
Figure 5:
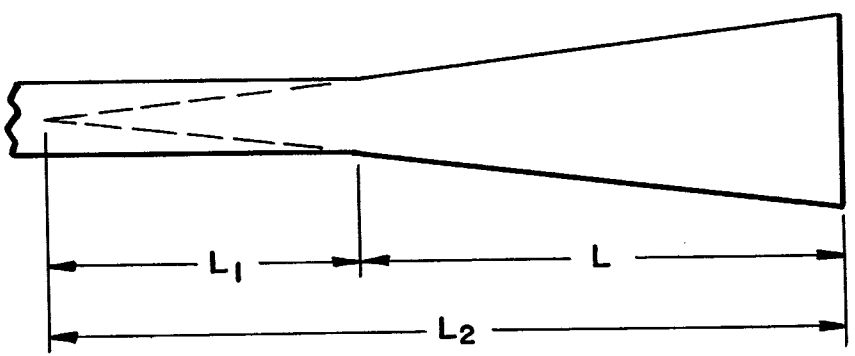
Figure 5B:
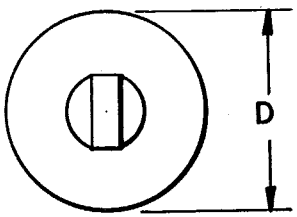

$C_L$ is the cross section area of the large horn $C_S$ is the cross section area of the small horn $D_L$ is the outside diameter of the large horn $D_S$ is the outside diameter of the small horn Where:

(a) λ=wavelength=11.803/f; f=frequency (b) $C_L=C_S$=2.000 (if the two horns are square or rectangular in cross section as shown in FIG. 5*a*) =1.706 (if the two horns are conical horns as shown in FIG. 5*b*)

(c) $L_1$, $L_2$, and D are as shown in FIG. 5

In the designing the phase compensator numerical calculation of the quantity on the right-hand-side of equation (2) is made as a function of frequency (f); if necessary, $L_R$, $L_T$, and $f_{CR}$ are varied slightly from their nominal values, defined in (a), (b) and (c) above, until a very close (or a sufficiently close) correlation is obtained with the known quantity on the left-hand-side of equation (2) at all frequencies in the band.

For most applications of the two-horn system, the best phase compensator design will generally be obtained for the case n=0 in equation (2). However, in some important instances, primarily for applications wherein it is required that U (f) not be zero, it has been found that the best phase compensator design corresponds to n being as large as plus 2. Moreover, it can be shown that a satisfactory design for a magnitude of n greater than 3 is a highly unlikely possibility.

The computation process or mathematical search described above has been greatly facilitated by programming equation (2) on an analog computer. As already inferred, it is imperative that the tapered sections be constructed in such a manner that equation (1) is satisfied. A summary of an applicable design procedure which has been found quite satisfactory follows:

The outer surfaces of either tapered section form a simple pyramid so that, referring to FIGS. 2 and 3, $$a(Z)=[(a_o)(L_T-Z)+Za_R]/L_T \text{ and} \quad (4)$$

$$b(Z)=[(b_o)(L_T-Z)+Zb_R]/L_T \quad (5)$$

define these cross-parameters where $Z_{aR}$ and $Z_{bR}$ are the internal height and width along the Z axis, respectively. For the design procedure, it is convenient to solve equations (4) and (5) for Z which yields:

$$Z=\frac{L_T\frac{b(Z)}{a(Z)}a_o-b_o}{b_R-b_o-\frac{b(Z)}{a(Z)}(a_R-a_o)} \quad (6)$$

where $b_R$ is the internal height of the central section 13. In the preferred embodiment, the width dimension S of the ridges in each tapered section is constant and equal to the value $S_R$ prevailing in the central section. Hence, $S(Z)=S_R=0.375a_R$ where $a_R$ is the internal width as described before and $$\frac{S(Z)}{a(Z)}=\frac{S_R L_T}{a_o(L_T-Z)+a_R Z} \quad (7)$$

Dividing equation (1) by equation (4) yields:

$$\frac{\lambda\, c(Z)}{a(Z)}=\frac{2a_o L_T+(\lambda\, CR-2a_o)(Z)}{a_o(L_T-Z)+a_R Z} \quad (8)$$

Many families of curves giving the λ/a relationship of doubly-ridged waveguides are published in the technical literature such as Broadband Ridged Horn Design by K. L. Walton and V. C. Sunberg in the Microwave Journal Vol. VII, No. 3, March 1964, pg. 98. These curves described in Walton's and Sunberg's "Broadband Ridged Horn Design" give exact answers for the case wherein the corners on the ridges are perfectly square. The remaining design procedure for the tapered sections makes use of these curves in conjunction with the above equations, as follows:

(a) Equation (6) is solved for many numerical values of Z by setting b(Z)/a(Z) therein equal, in turn, to the many values of b/a in aforementioned technical literature;

(b) S(Z)/a(Z) is then calculated using equation (7) for each Z obtained in step—(a);

(c) all the corresponding c(Z)/a(Z) are then determined from equation (8);

(d) many d(Z)/b(Z), or the ratio of the gap between the ridges d(Z) and the major height b(Z) of the cross section b, are then obtained directly from the computed curves in the aforementioned technical design curve literature with each specific value determined from corresponding family of curves used to obtain the corresponding (Z) for these d(Z)/b(Z) in step—(a); and (e) a sufficient number of points on the ridge-countour curve in the tapered sections, namely d(Z)/2, are then calculated from the identity $$\frac{d(Z)}{2}=\left\{\frac{d(Z)}{b(Z)}\right\}\left\{\frac{b_o(L_T-Z)+b_R Z}{2L_T}\right\} \quad (9)$$

using the many values of b(Z) obtained by equation (5); the ridge contour curve d(Z)/2 so obtained automatically satisfies the equation.

$$\frac{d(Z)}{2}=\frac{d(Z)\,b(Z)}{b(Z)\,2}$$

If ridges with square corners were used in a phase compensator and the surfaces of the ridges in the two tapered sections are machined, or otherwise constructed, in accordance with the appropriate contour curve obtained as described above, then the cut-off wavelength at any axial location Z in the corresponding tapered sections will satisfy the basic specification, equation (1), in an exact fashion. It should be noted that this precise calculation is performed for any of the four ridge contour curves, and the description of the calculation of one contour is deemed to apply to all four similar contour sections. For purely receiving or for relatively low-power transmitting applications, use of square-cornered ridges throughout the phase compensator and the ridge-contour curves for the ridges in the tapered sections obtained, as described above, would be satisfactory. A very precise equalization of the effective electrical length of the two horns would be obtained. However, in the preferred embodiment, ridges with slightly rounded corners are employed so as to substantially increase the peak power handling capability. The ridge-contour curve, obtained as described above, is a close approximation to the corresponding result applicable exactly to the preferred embodiment. It has been found, by experimentation, involving measurement of only the first resonant frequency of a ridged waveguide cavity yields information that can be employed to determine the slight perturbation of the above described ridge-contour curve, such that the perturbed contour-curve thereby obtained is the exact design result desired for the preferred embodiment. When this perturbed contour curve is employed, the cut-off wavelength in the tapered sections with ridges of the preferred type will precisely satisfy the basic specification, equation (1). Such an exact design may be necessary for system applications which require a very precise equalization of the effective electrical length of the applicable large and small horns.

It is to be noted that equations (4), (5) and (8), for Z equal to zero, yield:

$a(Z)=a(O)=a_o$ $b(Z)=b(O)=b_o$ $\lambda c(O)=2a(O)=2a_o$ equal cut-off wavelength of the standard rectangular waveguide where Z is equal to zero; then $$\frac{d(0)}{2}=\frac{b_o}{2}$$

These four specifications confirm or state that the ridges become vanishingly small in depth and that the cross section of the tapered section becomes identical to that of the standard rectangular waveguide at the merge-point (Z=O) of these components.

Similarly, at $Z=L_T$, the equations (4), (5) and (8) confirm that:

$a(L_T)=a_R$ $b(L_T)=b_R$ $c(L_T)=c_R$ equal cut-off wavelength of the doubly-ridged central section and that:

$$\frac{d(L_T)}{2}=\left[\frac{d(L_T)}{b(L_T)}\right]\left[\frac{b(L_T)}{2}\right]=\frac{d}{b_R}\ \frac{b_R}{2}=\frac{d}{2} \tag{10}$$

The cross section and cut-off wavelength, or cut-off frequency, of a tapered section becomes identical to those of the central section at their merge-point where $Z=L_T$. Now, as specified earlier:

$R=0.275\ d_e$ $a_R=b_R=1.35a_o$ $S_R=0.375a_R$

Furthermore, d(L) will have been determined in the form of equation (10), hence:

$$d=\left[\frac{d(L_T)}{b(L_T)}\right][b_R]=\left[\frac{d(L_T)}{b(L_T)}\right][1.35a_o]$$

will have been determined. Finally $L_R$, the length of the central section, will have been determined from the computational methods described previously in connection with the main design equation (2). Thus, the total design of any particular model of the subject invention can be completely specified to suit the applicable pair of dissimilar horn antennas.

An example of an embodiment of the present invention is presented by the design parameters and ridge-contour curve coordinates listed in Table I. This model of the invention was designed for the two horn antennas identified in part (c) of Table I. The data listed in Table II provides a summary of the performance of this embodiment of the invention from which it is evident that this model of the invention provides an extremely precise as well as an excellent degree of equalization of the effective electrical lengths of two greatly different horn antennas over a substantial frequency bandwidth.

TABLE I (a) Design Parameters of Phase Compensator $f_{CR}$ = 2.3 Ghz; $L_T$ = 4.00", $L_R$ = 15.135"

$\lambda R = b_R$ = 1.35", $d_e$ = 0.251$b_R$, $S_R$ = 0.375$d_e$ $a_o = 2b_o$ = 1.02"

(b) Ridge-Contour Curve Coordinates

| d(Z)/2 | Z |
|---|---|
| .255 | .250 |
| .221 | .500 |
| .200 | 1.000 |
| .188 | 1.500 |
| .185 | 1.750 |
| .182 | 2.000 |

(c) Designed and Constructed for Rectangular Horns

Described by:

$L_L$ = 30.0"; $D_L$ = 9.5" (large horn)

$L_S$ = 5.65"; $D_S$ = 3.6" (small horn)

Note:
Only a selected number of a plotted points are shown.

TABLE II

| Electrical Length of Strictly Ideal Compensator (A) (Left-side-of-equation (2) with, in this case "n" = −2 therein) | Signal Frequency |
|---|---|
| Degrees: | Ghz: |
| 4524.5 | 7 |
| 4889.3 | 7.5 |
| 5272.3 | 8.0 |
| 5644.7 | 8.5 |
| 6008.0 | 9.0 |
| 6388.8 | 9.5 |
| 6768.4 | 10.0 |
| 7139.5 | 10.5 |
| 7514.4 | 11.0 |
| 7679.7 | 11.225 |

| Measured Electrical Length of Actual Embodiment of Phase Compensator (B) | Difference Between (A) and (B) in degrees | and as % of (A) |
|---|---|---|
| Degrees: | Degrees: | Percent: |
| 4510.7 | 13.8 | 0.307 |
| 4890.7 | −1.4 | 0.029 |
| 5277.4 | −5.1 | 0.097 |
| 5654.1 | −9.4 | 0.167 |
| 6028.1 | −20.1 | 0.344 |
| 6399.8 | −11.0 | 0.178 |
| 6771.5 | −3.1 | 0.046 |
| 7135.4 | 4.1 | 0.058 |
| 7504.7 | 9.7 | 0.129 |
| 7769.4 | 10.3 | 0.134 |

It should be noted that the unique invention is not limited to the above embodiment, but encompasses all possible variations of the preferred embodiment, as they apply to all possible pairs of dissimilar horn antennas. For any given case, the four similar exactly-curved ridges for use in the two tapered sections can be realized by utilization of a template, or the mandrel illustrated in FIG. 2a, constructed in accordance with the applicable procedure and specifications described herein.

What is claimed is:

1. An electrical-length equalizer waveguide for a pair of horn antennas including a standard waveguide section, said equalizer comprising:

(a) a uniform doubly-ridged central waveguide device;

(b) a first tapered doubly-ridged waveguide section located at one end of said central section;

(c) a second tapered doubly-ridged waveguide section located at other end of said central section;

(d) said first and said second waveguide sections each comprising two opposed and diverging ridges located within said first and said second tapered waveguide sections wherein the propogation cut-off wavelength $\lambda_c(Z)$ at all Z axis locations in said first and said second tapered sections varies continuously such that said propogation cut-off wavelength $\lambda_c(Z)$ is equal to $2a_o+(\lambda cR-2a_o)/L_T(Z)$ wherein $a_o$ is the internal width of the standard waveguide connected to either end of said equalizer; $\lambda_{cR}$ is the cut-off wavelength of the lowest order $TE_{10}$-Mode of propogation in said central section and $L_T$ is the axial length of each of said tapered sections wherein beginning at one end of said tapered sections where Z is equal to zero and $\lambda_c(O)$ is equal to twice the internal width of the standard rectangular waveguide $2a_o$ and ending at Z equaling the length of said tapered section $L_T$ wherein $\lambda_c(L_T)$ is equal to the cut-off wavelength in said central section.

2. The device recited in claim 1 wherein height of the ridges of said doubly-ridged waveguide central sections are constant within said central section.

3. The device recited in claim 2 wherein the height of the ridges in the tapered sections is continuously varied.

4. The device recited in claim 3 wherein the width of the ridges is constant.

5. The device recited in claim 1 wherein the height of each ridge at any location on the Z axis in said tapered sections varies and is defined by the equation $$\frac{d(Z)}{2} = \left[\frac{d(Z)}{b(Z)}\right]\left[\frac{b_o(L_T) - Z) + b_R Z}{L_T}\right]$$

where d(Z) is the gap between the ridges b(Z) is the major height of the cross-section, b is the major height of the cross-section, $b_o$ is the internal height of the waveguide, $L_T$ is the axial length of each of said tapered sections, $b_R$ is the internal height of said central section and where the ratio $$\left[\frac{d(Z)}{b(Z)}\right]$$

is set for all points of Z in said tapered section.

6. The device recited in claim 5 wherein the corners of the interior edges of the ridges are rounded as defined by the equation 0.275d where d is the width of the constant gap between opposing ridges in said central section.

7. The device recited in claim 6 wherein the waveguide cross section forms a doubly-ridged aperture.

* * * * *